US011793248B2

(12) United States Patent
Raciti et al.

(10) Patent No.: US 11,793,248 B2
(45) Date of Patent: Oct. 24, 2023

(54) GARMENT WITH VISUAL INDICIA

(71) Applicants: Richard Raciti, Sebastian, FL (US); Paul Jasinkiewicz, Bernardsville, NJ (US)

(72) Inventors: Richard Raciti, Sebastian, FL (US); Paul Jasinkiewicz, Bernardsville, NJ (US)

( * ) Notice: Subject to any disclaimer, the term of this patent is extended or adjusted under 35 U.S.C. 154(b) by 213 days.

(21) Appl. No.: 17/391,807

(22) Filed: Aug. 2, 2021

(65) Prior Publication Data

US 2022/0378121 A1 Dec. 1, 2022

Related U.S. Application Data

(63) Continuation-in-part of application No. 29/786,575, filed on Jun. 1, 2021.

(51) Int. Cl.

| | |
|---|---|
| ***A41D 13/00*** | (2006.01) |
| ***A41D 11/00*** | (2006.01) |
| ***A63B 71/06*** | (2006.01) |

(52) U.S. Cl.

CPC ..... *A41D 13/00* (2013.01); *A41D 13/0015* (2013.01); *A41D 11/00* (2013.01); *A63B 2071/0694* (2013.01)

(58) Field of Classification Search

CPC ..... A41D 13/00; A41D 13/0015; A41D 13/1236; A41D 11/00; A41D 27/08; G09B 19/0015; G09B 19/0023; G09B 19/0076; G09B 1/16; A63B 71/06; A63B 2071/0694

USPC ..... 2/244, 246

See application file for complete search history.

(56) References Cited

U.S. PATENT DOCUMENTS

| | | | | |
|---|---|---|---|---|
| 3,724,101 | A * | 4/1973 | Slezak | G09B 17/00 40/586 |
| 3,949,488 | A * | 4/1976 | Welch | A63H 3/28 446/302 |
| 4,253,197 | A | 3/1981 | Posta | |
| 4,530,349 | A | 7/1985 | Metzger | |
| 5,282,749 | A | 2/1994 | Ketch | |
| 5,468,152 | A | 11/1995 | Lenart | |

(Continued)

FOREIGN PATENT DOCUMENTS

| | | |
|---|---|---|
| CN | 213549901 U | 6/2021 |
| FR | 2918847 B1 | 3/2010 |
| GB | 2486446 A | 6/2012 |

OTHER PUBLICATIONS

Notification of transmittal of the International Search Report with written opinion issued by the International Searching Authority for International Patent Application No. PCT/US2022/038524, dated Oct. 27, 2022.

(Continued)

*Primary Examiner* — Jocelyn Bravo

(74) *Attorney, Agent, or Firm* — MYERS WOLIN, LLC

(57) ABSTRACT

A garment includes: a plurality of distinct regions, each region corresponding to a body part or type of body part of a wearer when worn; and a plurality of visual indicia, each of the visual indicia having at least one unique visual characteristic. Each of the plurality of visual indicia is located at a corresponding one of the plurality of distinct regions. At least one secondary visual characteristic of each of the indicia is associated with the corresponding distinct region.

17 Claims, 6 Drawing Sheets

(56) References Cited

U.S. PATENT DOCUMENTS

| | | | | |
|---|---|---|---|---|
| 5,479,661 | A | 1/1996 | Fingleson et al. | |
| 5,826,879 | A * | 10/1998 | Spector | F41J 5/24 273/349 |
| 6,353,932 | B2 * | 3/2002 | Stembridge | A41D 13/0015 463/8 |
| D539,508 | S | 4/2007 | Rogers et al. | |
| D558,953 | S | 1/2008 | Rogers et al. | |
| 8,702,427 | B1 | 4/2014 | Prestwood | |
| D785,291 | S | 5/2017 | Nuzzo | |
| D825,141 | S | 8/2018 | Jeong | |
| D825,142 | S | 8/2018 | Jeong | |
| D842,587 | S | 3/2019 | Pumphrey | |
| D847,465 | S | 5/2019 | Hornsby | |
| 10,362,815 | B2 | 7/2019 | Thompson | |
| 2001/0054193 | A1 * | 12/2001 | Stembridge | A41D 13/0015 2/69 |
| 2004/0171412 | A1 | 9/2004 | Vollmar, Jr. | |
| 2007/0000007 | A1 * | 1/2007 | MacDonald | A41D 13/0015 2/69 |
| 2007/0287620 | A1 | 12/2007 | Hiburger | |
| 2010/0261147 | A1 | 10/2010 | Polansky | |
| 2010/0299810 | A1 * | 12/2010 | Snyder | A41D 27/08 2/244 |
| 2013/0130870 | A1 | 5/2013 | McCranor | |
| 2013/0225042 | A1 * | 8/2013 | Ave | G09F 21/026 2/69 |
| 2015/0064674 | A1 * | 3/2015 | Turnbull | A63B 69/26 434/247 |
| 2017/0148344 | A1 * | 5/2017 | Abramowitz | G09B 19/0015 |
| 2021/0093027 | A1 * | 4/2021 | Ladas | A41D 27/08 |

OTHER PUBLICATIONS

Chest Protection Vest, Sakura Martial Arts Supplies, accessed Jun. 1, 2021 [URL: https://www.sakuramartialarts.com/Martial_Arts_Protect_Gear_Reversible_Dotted_Vest_p/pro-2216-a1.htm].

* cited by examiner

GARMENT WITH VISUAL INDICIA

CROSS-REFERENCE TO RELATED APPLICATIONS

This is a continuation-in-part of U.S. application Ser. No. 29/786,575, filed Jun. 1, 2021, the contents of which are incorporated by reference herein.

FIELD

The present disclosure generally relates to a garment with visual indicia.

BACKGROUND

When asked to follow directions or focus on a task, individuals vary greatly in their cognitive abilities to: 1) focus, 2) understand and process instructions, 3) formulate a plan to carry out the task, and 4) actually perform the steps required to complete the requested action. Directions that are simple for most people to follow may be extremely difficult for others. Young children, people with learning disabilities and people that have experienced some form of injury/trauma often have difficulty understanding and processing very basic distinctions that most people take for granted—distinctions such as 'right' versus 'left', for example. These same groups of people may, however, have cognitive abilities that are much more geared towards processing concepts in terms of colors or geometric shapes. For example, asking a cognitively impaired or not yet developed person to touch their right elbow may cause confusion. However, asking that same person to touch a red circle on the sleeve of their shirt at the right elbow is often a straight-forward task.

When an individual is unable to follow directions and perform basic tasks, it often leads to a breakdown of focus and attention—when this happens, not only has that individual lost his or her ability to participate in the activity, that individual often becomes disruptive to the people around them. In one example with an autistic child at a birthday party hosted at a martial arts school, the autistic child (who was unable to follow directions and maintain focus), became disruptive to the entire group of children and detracted from the happiness of the event. It is because of the potential for these types of disruptions that many martial arts schools are reluctant to enroll autistic students into their group classes.

There is a need, therefore, to provide a way for an instructor, in the previous example, for example, to better engage individuals that face cognitive deficiencies. The present inventor has found, for example, that people on the autism spectrum often understand and respond very well to colors and shapes, which provided the inspiration for the garment of the present disclosure. In one embodiment of the present disclosure, there is provided a garment with various and uniquely colored geometric shapes at strategic locations on a martial arts uniform. In other embodiments, other garment types (i.e., lab coats, uniforms, etc.) may be used. In other embodiments, this concept can be applied to other environments such as physical therapy and rehabilitation.

The description provided in the background section should not be assumed to be prior art merely because it is mentioned in or associated with the background section. The background section may include information that describes one or more aspects of the subject technology.

SUMMARY

A first objective of this disclosure is to provide an aid and method to the enhancement of self-protection skills. A second objective is as an aid to achieving, regaining, and retaining physical and mental skills for the purpose of being able bodied, self-sufficient, and capable of carrying out normal daily tasks. Another objective is to provide an aid and method to better communicate with individuals with cognitive deficiencies. Another objective of this disclosure is to achieve the various objectives concurrently.

One embodiment of the present disclosure may provide a garment. The garment may include: a plurality of distinct regions, each region corresponding to a body part or type of body part of a wearer when worn; and a plurality of visual indicia, each of the visual indicia having at least one unique visual characteristic. Each of the plurality of visual indicia is located at a corresponding one of the plurality of distinct regions. At least one secondary visual characteristic of each of the indicia is associated with the corresponding distinct region.

Another embodiment of the present disclosure may provide a method. The method may include preparing a garment including: a plurality of distinct regions, each region corresponding to a body part or type of body part of a wearer when worn; and a plurality of visual indicia, each of the visual indicia having at least one unique visual characteristic. Each of the plurality of visual indicia is located at a corresponding one of the plurality of distinct regions, wherein at least one secondary visual characteristic of each of the indicia is associated with the corresponding distinct region. The method may further include engaging the plurality of visual indicia.

DRAWINGS

EMBODIMENTS

Figure 1:
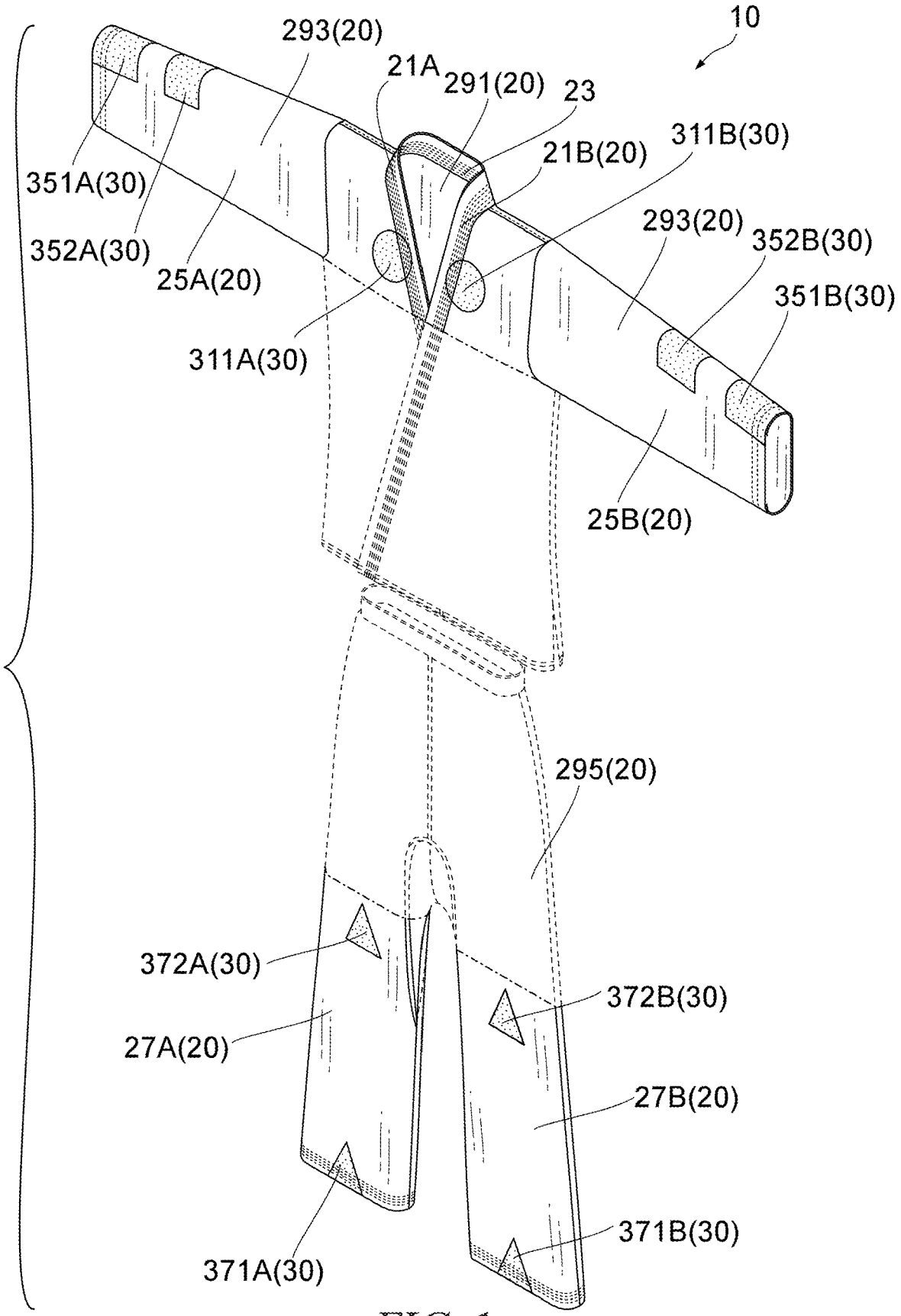
FIG. 1 illustrates a perspective view of a garment according to one embodiment.

The description of illustrative embodiments according to principles of the present disclosure is intended to be read in connection with the accompanying drawings, which are to be considered part of the entire written description. In the description of embodiments of the disclosure disclosed herein, any reference to direction or orientation is merely intended for convenience of description and is not intended in any way to limit the scope of the present disclosure. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the disclosure are illustrated by reference to the exemplified embodiments. Accordingly, the disclosure expressly should not be limited to such exemplary embodiments illustrating some possible non-limiting combination of features that may exist alone or in other combinations of features; the scope of the disclosure being defined by the claims appended hereto.

This disclosure describes the best mode or modes of practicing the disclosure as presently contemplated. This description is not intended to be understood in a limiting sense, but provides an example of the disclosure presented solely for illustrative purposes by reference to the accompanying drawings to advise one of ordinary skill in the art of the advantages and construction of the disclosure. In the various views of the drawings, like reference characters designate like or similar parts.

It is important to note that the embodiments disclosed are only examples of the many advantageous uses of the innovative teachings herein. In general, statements made in the specification of the present application do not necessarily limit any of the various claimed disclosures. Moreover, some statements may apply to some inventive features but not to others. In general, unless otherwise indicated, singular elements may be in plural and vice versa with no loss of generality.

The present disclosure can provide a garment with visual indicia specifically positioned to establish target areas for a person to reach, touch, hold, grab, pull, push, or twist to enhance focus, gross and fine motor skills, mobility, posture, strength, therapy, physical rehabilitation, memory, following directions, and personal protection.

Some embodiments may relate to enhancement of physical, mental and functional skills for people with and without disabilities.

In some embodiments, the garment may be provided with visual indicia placed in specifically targeted areas that represent areas of the body where the subject will be instructed to point to, place a hand, hold, grab, push, pull, twist, lift up, pull down, grip, and release for the purposes of enhancing fine and gross motor skills, coordination, focus, strength, determination, memory, therapy, physical rehabilitation, mobility, posture, personal protection, and direction following. The garment may be worn by an instructor, by a student, a client, a patient, a therapist, or a health care provider, or on both depending on the therapy being administered and or the goals of the parties utilizing the equipment.

One objective of this embodiment is to be an aid and method to the enhancement of self-protection skills. Another objective is as an aid to achieving, regaining, and retaining physical and mental skills for the purpose of being able bodied, self-sufficient, and capable of carrying out normal daily tasks. The therapy that this embodiment facilitates is unique in its ability to increase human touch and feel in the process of teaching, rehabilitating and training of clients, students, and patients.

The mental health benefit of this embodiment is particularly useful to subjects on the Autism Spectrum, Asperger's Syndrome, Attention Deficit Disorder, and Dyslexia. Children of relatively young ages as well as individuals with other physical or mental impairments may have difficulty with certain cognitive thinking and function. Shapes and colors are attractive to individuals lacking certain core cognitive skills. The embodiment is therefore a multidimensional instrument that enhances core cognitive skills by utilizing the equipment for sustaining attention through fun drills that limit response inhibition and speed up information processing. The equipment also enhances an active working memory through pattern recognition, category formation, and simultaneous responses.

Figure 2:
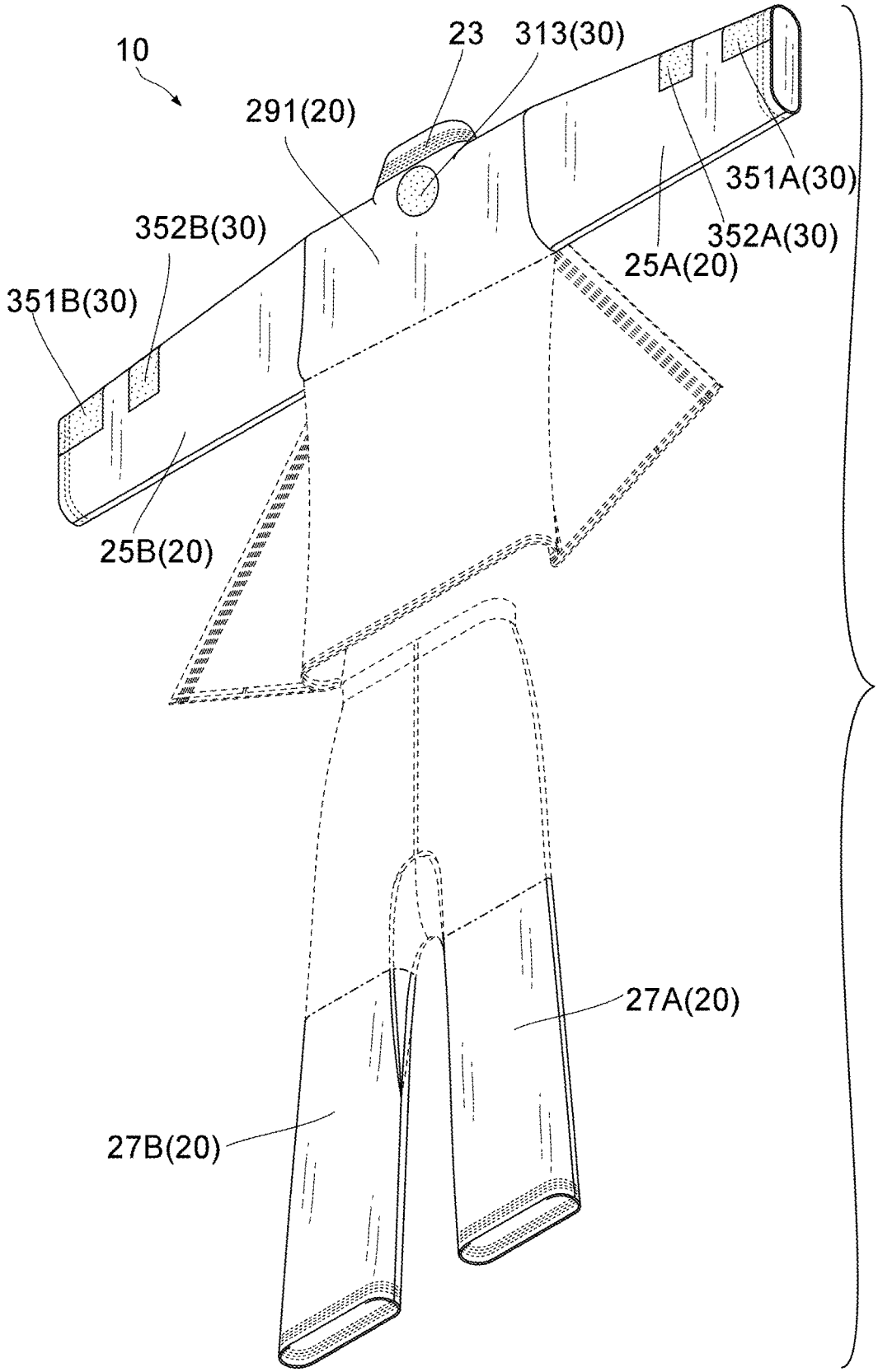
FIG. 2 illustrates another perspective view of a garment according to one embodiment.

FIG. 1 illustrates a perspective view of a garment according to one embodiment. FIG. 2 illustrates another perspective view of a garment according to one embodiment.

As shown in FIGS. 1-2, a garment 10 may include a plurality of distinct regions 20 and a plurality of visual indicia 30. Although a variety of types of garments may be utilized with visual indicia, an example of uniform-type garment with pants is disclosed in the following discussion and accompanying figures, but other types of garments may be used. Examples of garments include any garments that cover a portion of a torso of the wearer and may extend over arms of the wearer, and/or any of a plurality of garments that cover a portion of a pelvic region of the wearer and may extend over legs of the wearer. Examples of garments further include long-sleeved shirts, short-sleeved shirts, tank tops, undershirts, jackets, coats, pants, shorts, briefs, jeans, and underwear. Other examples of garments include any garments that cover any portion of a body of the wearer, alone or in combination with a portion that may extend over arms of the wearer, and/or any of a plurality of garments that cover a portion of a pelvic region of the wearer and may extend over legs of the wearer. Additional examples of garments further include footwear and hats, for example, alone or in combination with other garments such as long-sleeved shirts, short-sleeved shirts, tank tops, undershirts, jackets, coats, pants, shorts, briefs, jeans, and underwear.

A variety of materials may be utilized in manufacturing the garment 10. In general, the garment 10 may be formed from knitted, woven, or non-woven textile materials that include rayon, nylon, polyester, polyacrylic, cotton, wool, or silk, for example. Although the garment 10 may be knitted as a unitary (i.e., one-piece) article, the garment 10 may also be formed from a plurality of textile elements that are sewn, bonded, adhered, or otherwise joined together.

In the illustrated example of FIG. 1, each region 20 corresponds to a body part or type of body part of the wearer when worn. The plurality of distinct regions 20 may include a chest or collar region 291, an arm region 293, and a leg region 295. Each of the chest or collar region 291, the arm region 293, and the leg region 295 may include a front side and a back side. The chest or collar region 291 may include a right collar region 21A, a left collar region 21B, a top collar region 23. The arm region 293 may include a right sleeve region 25A and a left sleeve region 25B. The leg region 295 may include a right leg region 27A, and a left leg region 27B. In some embodiments, the plurality of distinct regions 20 may include at least two of: the right collar region 21A, the left collar region 21B, the top collar region 23, the right sleeve region 25A, the left sleeve region 25B, the right leg region 27A, and the left leg region 27B.

Each of the plurality of visual indicia 30 may be located at a corresponding one of the plurality of distinct regions 20. Each of the visual indicia 30 may have at least one unique visual characteristic. The at least one unique visual characteristic may be one of color and shape. At least one secondary visual characteristic of each of the indicia 30 may be associated with the corresponding distinct region 20. The secondary visual characteristic may be the other one of color and shape that is not the at least one unique visual characteristic. The secondary visual characteristic of each of the indicia 30 may be consistent across multiple indicia 30 of the plurality of visual indicia 30 in a corresponding distinct region 20 and the unique visual characteristic is distinct for each of the indicia 30.

In the illustrated example of FIG. 1, the plurality of visual indicia 30 includes: a) a first indicia 311A at the right collar region 21A; b) a second indicia 311B at the left collar region 21B; c) third and fourth indicia 351A and 352A at the right sleeve region 25A; d) fifth and sixth indicia 351B and 352B at the left sleeve region 25B; e) seventh and eighth indicia 371A and 372A at the right leg region 27A, where the seventh indicia 371A is located at the bottom seam; and f) ninth and tenth indicia 371B and 372B at the left leg region 27B, where the ninth indicia 371B is located at the bottom seam. Further, as shown in FIG. 2, the plurality of visual indicia 30 includes another indicia 313 at the top collar region 23.

In the illustrated example of FIG. 1, the first and second indicia 311A and 311B have the same secondary visual characteristic (e.g., circular shape) but different unique visual characteristics (e.g., color). The third, fourth, fifth, and sixth indicia 351A, 352A, 351B, and 352B all have the same secondary visual characteristic (e.g., square shape) but different unique visual characteristics (e.g., color). The seventh, eighth, ninth, and tenth indicia 371A, 372A, 371B, and 372B have the same secondary visual characteristic (e.g., triangle shape) but different unique visual characteristics (e.g., color). In the illustrated example of FIG. 1, the secondary visual characteristics (e.g., shape) of the first, third, and seventh indicia 311A, 351A, and 371A may be different from each other. The unique visual characteristics (shape and color) of the first through tenth indicia 311A, 311B, 351A, 351B, 352A, 352B, 371A, 372A, 371B, and 372B may be different from each other. Examples of the shapes and colors of visual indicia 30 are as follows. The first visual indicia 311A: blue circle; the second visual indicia 311B: red circle; the third visual indicia 351A: green square; the fourth visual indicia 352A: orange square; the fifth visual indicia 351B: yellow square; the sixth visual indicia 352B: purple square; the seventh visual indicia 371A: white triangle; the eighth visual indicia 372A: brown triangle; the ninth visual indicia 371B: grey triangle; and the tenth visual indicia 372B: pink triangle. Also, the indicia 313 at the top collar region 23 may be circular in a color different from the other indicia.

In other embodiments, the indicia on the right side (i.e., the indicia 311A, 351A, 352A, 371A, and 372A) may have the same visual characteristic (e.g., blue color), and the indicia on the left side (i.e., indicia 311B, 351B, 352B, 371B, and 372B) may have the same visual characteristic (e.g., red color), while the visual characteristic (e.g., blue color) of the indicia on the right side and the visual characteristic (e.g., red color) of the left side may be different. In these embodiments, the indicia on the right side (i.e., the indicia 311A, 351A, 352A, 371A, and 372A) may have distinct geometric shapes, and the indicia on the left side (i.e., indicia 311B, 351B, 352B, 371B, and 372B) may have may have distinct geometric shapes. Examples of the shapes and colors of visual indicia 30 are as follows. The first visual indicia 311A: red circle; the second visual indicia 311B: blue circle; the third visual indicia 351A: red square; the fourth visual indicia 352A: red star shape; the fifth visual indicia 351B: blue square; the sixth visual indicia 352B: blue star shape; the seventh visual indicia 371A: red diamond shape; the eighth visual indicia 372A: red triangle; the ninth visual indicia 371B: blue diamond shape; and the tenth visual indicia 372B: blue triangle.

The above shapes and colors of the visual indicia 30 are only examples, and any other combinations of shapes and colors may be used.

Figure 3:
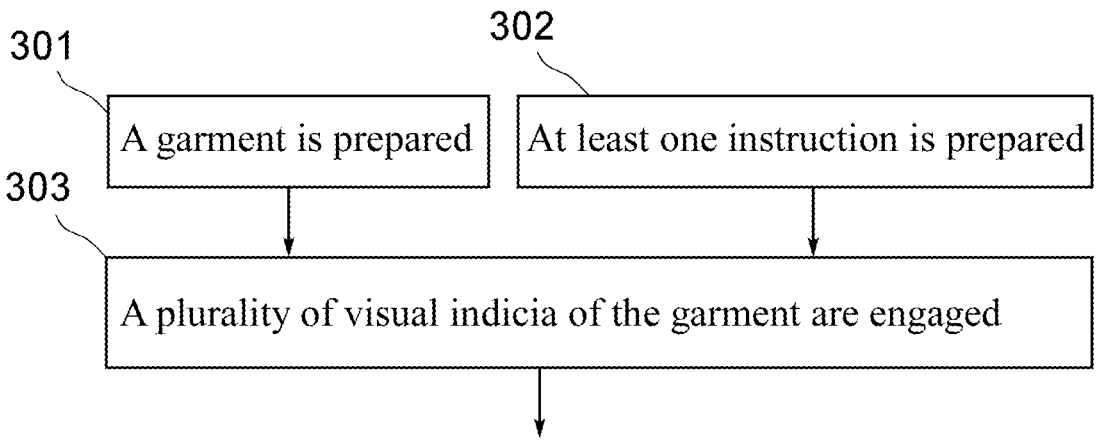
FIG. 3 illustrates a flowchart showing use of a garment according to one embodiment.

FIG. 3 illustrates a flowchart showing use of a garment according to one embodiment.

Figure 4:
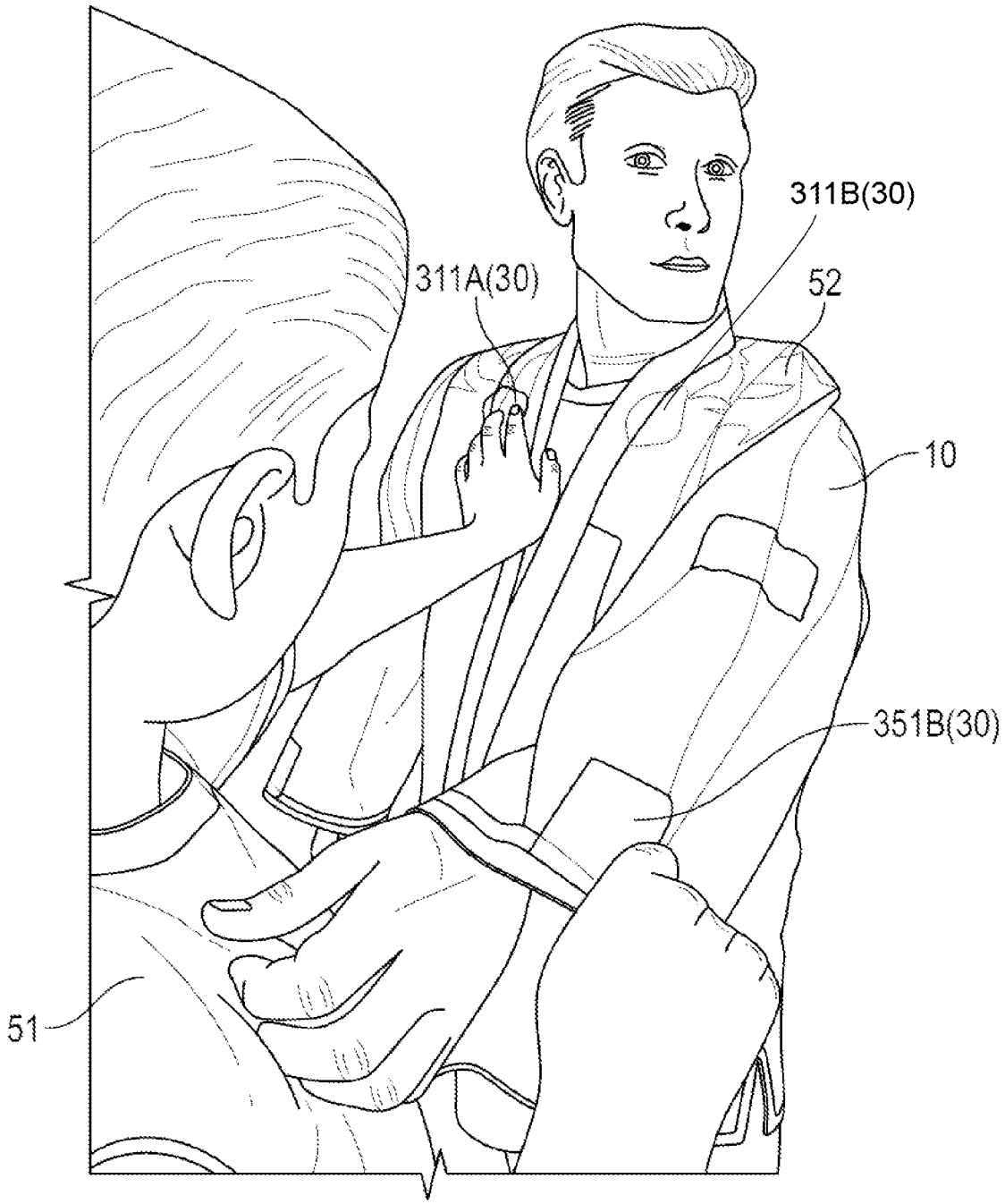
FIGS. 4-6 illustrate examples of use of a garment according to some embodiments.

With reference to FIG. 3, in 301, the garment 10 is prepared. Optionally, in 302, at least one instruction of using the plurality of visual indicia 30 of the garment 10 is prepared. The at least one instruction may include instructional manual with all of the different types of motions corresponding to different skills. In 303, the plurality of visual indicia 30 are engaged. With reference to FIGS. 3 and 4, in one example, such engaging in 303 includes providing at least one instruction of using the garment 10 to a first person 51 in case the garment 10 is worn by a second person 52. The at least one instruction may include instructing the first person 51 to place one hand of the first person 51 on one indicia of the plurality of visual indicia 30 of the garment 10 that is worn by the second person 52. The at least one instruction may further include instructing the first person to place the hand or the other hand on another of the plurality of visual indicia 30 of the garment 10 that is worn by the second person 52. The placing of a hand on visual indicia may include at least one of holding, grabbing, touching, pushing, pulling, twisting, lifting up, pulling down, gripping, striking, and hitting the visual indicia.

Figure 5:
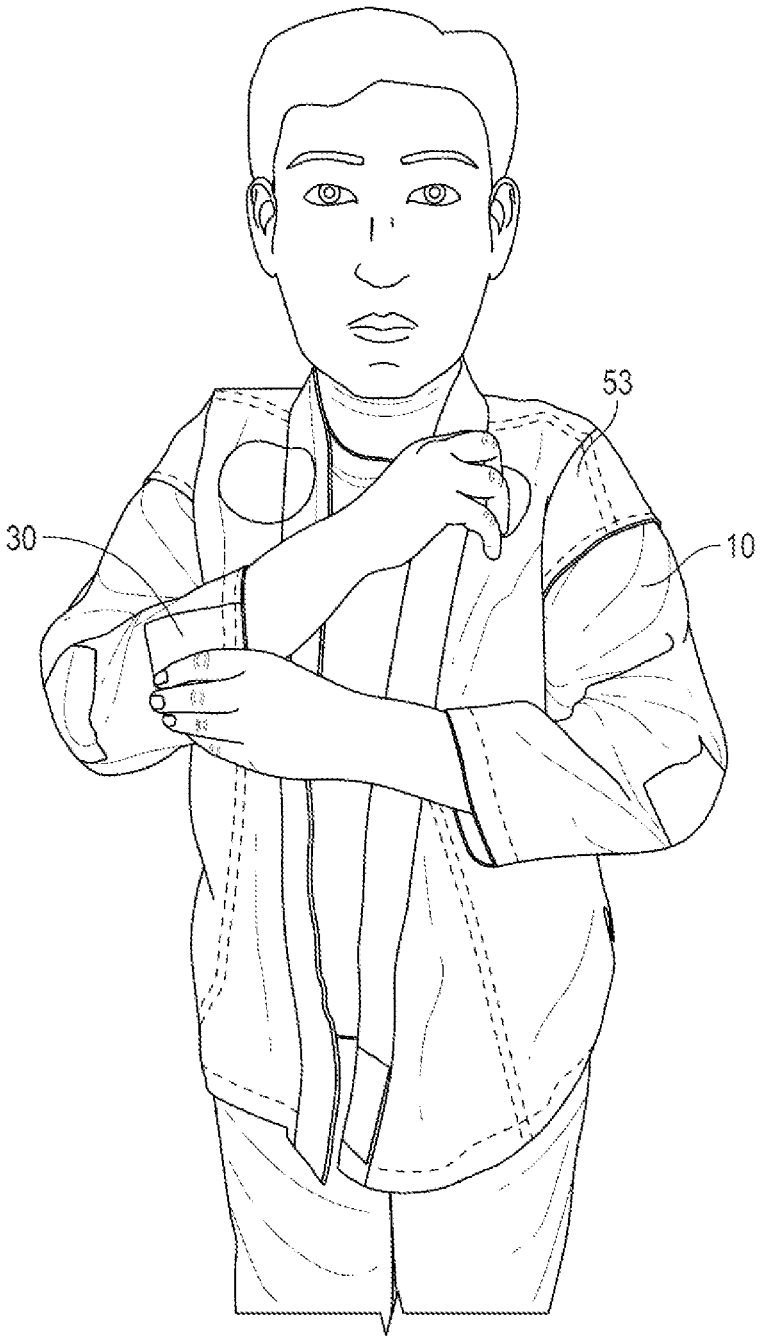
Figure 6:
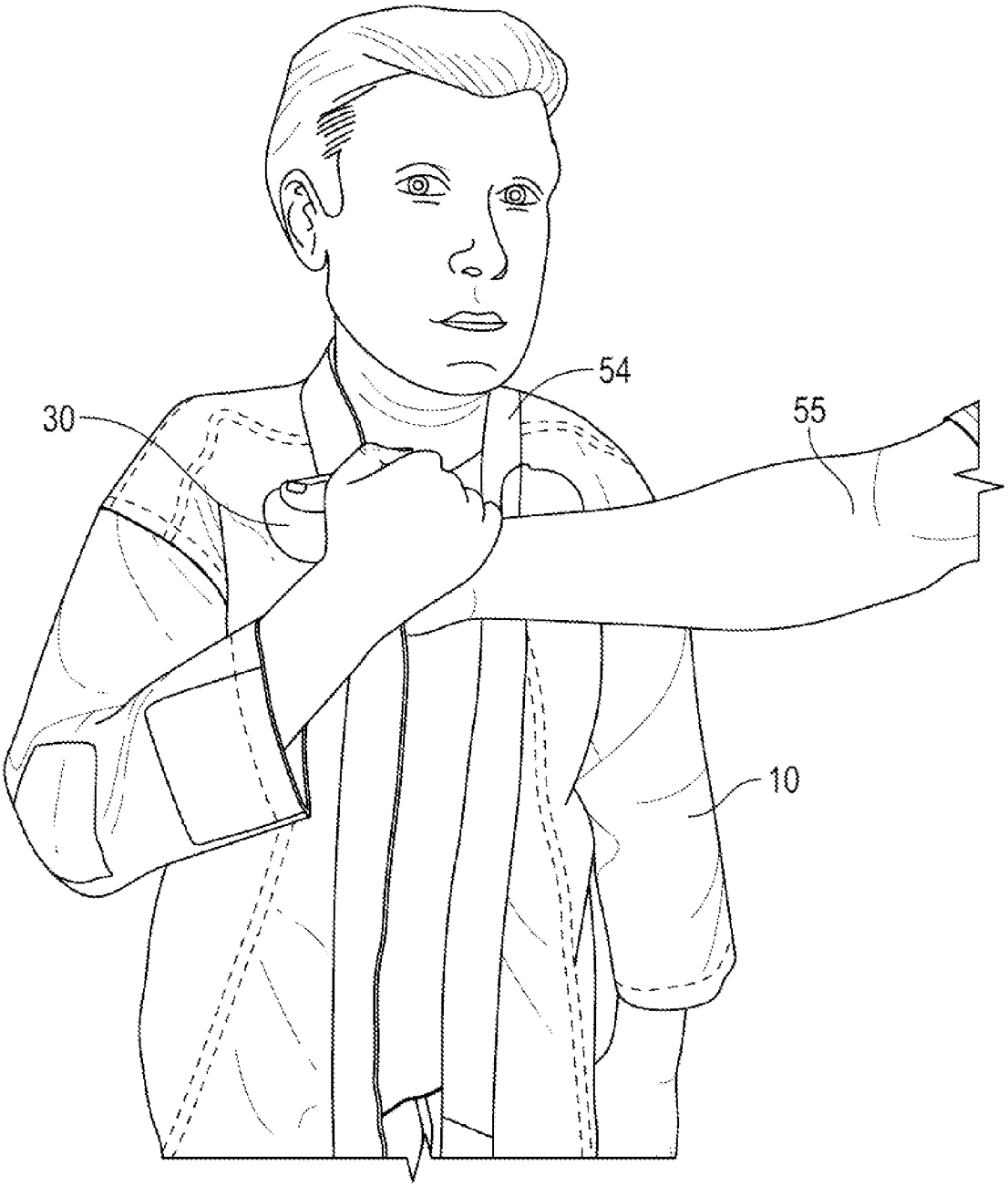

FIGS. 4-6 illustrate examples of use of a garment according to some embodiments. In the examples of FIGS. 4-6, persons, who may include students and instructors, may follow the at least one instruction (e.g., easy-to-use guides) based on indicia 30 to execute on different movements.

In the illustrated example of FIG. 4, the first person 51 is instructed to follow out various hand functions on the second person 52 wearing the garment 10 such as placing a hand or hands on a specifically instructed target or targets, which may be shown by visual indicia 30. The first person 51 may be instructed in specific target recognition by grabbing, grabbing and pulling, grabbing and pushing, and resistance to having hands being pulled from targets. The first person 51 can be instructed in multiple sequences and hand placements. For example, the first person 51 is instructed by the second person 52 who is wearing the garment 10 to place the left hand on the indicia 311A located on the collar region and grab the indicia 311B lightly and hold the indicia 311A. The first person 51 is then instructed to use the right hand and lightly grab the indicia 351B which is located on the sleeve. The first person 51 is then instructed to release the indicia 311A and switch to the indicia 352A (see FIG. 1). The instructions, sequences, grips, grabs, pushes, pulls and resistances can be done in a multitude of arrangements where hand placement and grips are changing with varying speeds, degree of strength, and memorization.

In the embodiments, the visual characteristics (e.g., shape or color) of the garment may represent target points, and may be used to instruct a person where to place a hand (e.g., holding, grabbing, touching, pushing, pulling, twisting, lifting up, pulling down, or gripping) to enhance focus, strength, agility, motor skills, cognitive thinking and/or coordination. The user of the garment may use varying levels of resistance to increase strength. Further, strength building, comfort with person to person contact, and confidence may be engaged while the person is performing the tasks.

In another example shown in FIG. 5, the person 53 may be instructed to wear the garment 10. Individuals who are mentally impaired can often follow instructions that are based on shapes and colors, rather than locations. These individuals may have difficulty comprehending "grab left collar region," but these individuals may easily understand "grab red circle" or "grab the circle with one hand, then the "grab another circle" with the other hand." In the illustrated example in FIG. 5, the person 53 may be instructed to place either one or both hands of the person 53 on one indicia 30 of the plurality of visual indicia 30 of the garment 10 that is worn by the person 53. In this example, the wearer (e.g., the person 53) may be instructed in various grip choices by color/shape utilizing either one or both hands to demonstrate familiarity with the garment as well as focus, coordination, motoring skills, and cognitive thinking. The instructor may use varying levels of force to try and pull the grips off causing the wearer to increase resistance, strength, and determination.

In another example shown in FIG. 6, the first person 54 may be instructed to wear the garment 10. In this example, the first person 54 may be instructed grab a hand of a second person 55 who is placing the hand on one indicia 30 of the plurality of visual indicia 30 of the garment 10 that is worn by the first person 54. In this example, the wearer (e.g., the first person 54) may use strength and coordination to peel the hand of the instructor (e.g., the second person 55) from the garment 10. This can teach the wearer how to release a grip when it is unwanted or from a stranger.

While the present disclosure has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the disclosure.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A garment, comprising:

a plurality of distinct regions, each region corresponding to a body part or type of body part of a wearer when worn; and a plurality of visual indicia, each of the visual indicia having at least one unique visual characteristic, wherein each of the plurality of visual indicia is located at a corresponding one of the plurality of distinct regions, wherein at least one secondary visual characteristic of each of the indicia is associated with the corresponding distinct region, wherein the plurality of visual indicia includes:

a first indicia at a right collar region;

a second indicia at a left collar region, the first and second indicia having a same secondary visual characteristic but different unique visual characteristics, third and fourth indicia at a right sleeve region;

fifth and sixth indicia at a left sleeve region, the third, fourth, fifth, and sixth indicia all having a same secondary visual characteristic but different unique visual characteristics, seventh and eighth indicia at a left leg region; and ninth and tenth indicia at a left leg region, the seventh, eighth, ninth, and tenth indicia having a same secondary visual characteristic but different unique visual characteristics, wherein the secondary visual characteristics of the first, third, and seventh indicia are different from each other, and wherein the unique visual characteristics of the first through tenth indicia are different from each other.

2. The garment of claim 1, wherein the plurality of distinct regions include at least two of: a right collar region, a left collar region, a top collar region, a right sleeve region, a left sleeve region, a right leg region, and a left leg region.

3. The garment of claim 1, wherein the at least one unique visual characteristic is one of color and shape.

4. The garment of claim 1, wherein the secondary visual characteristic is the other one of color and shape that is not the at least one unique visual characteristic.

5. The garment of claim 1, wherein the plurality of distinct regions are an arm region, a chest or collar region, and a leg region.

6. The garment of claim 1, wherein the secondary visual characteristic of each of the indicia is consistent across multiple indicia of the plurality of visual indicia in a corresponding distinct region and the unique visual characteristic is distinct for each of the indicia.

7. A method, comprising:

preparing the garment of claim 1; and engaging the plurality of visual indicia.

8. The method of claim 7, wherein the engaging includes providing at least one instruction of using the garment, the at least one instruction including instructing a first person to place a hand of the first person on one indicia of the plurality of visual indicia of the garment.

9. The method of claim 8, wherein the garment is worn by a second person, and the at least one instruction including:

instructing the first person to place the hand of the first person on the one indicia of the garment that is worn by the second person.

10. The method of claim 8, wherein the at least one instruction includes:

instructing the first person to wear the garment; and instructing the first person to place the hand of the first person on the one indicia of the garment that is worn by the first person.

11. The method of claim 8, wherein the at least one instruction includes instructing the first person to place the hand or the other hand on another indicia of the plurality of visual indicia of the garment.

12. The method of claim 8, wherein the placing of the hand includes at least one of holding, grabbing, touching, pushing, pulling, twisting, lifting up, pulling down, gripping, striking, and hitting the indicia.

13. The method of claim 7, wherein the engaging includes providing at least one instruction of using the garment, the at least one instruction including instructing a first person to grab a hand of a second person who is placing a hand on one indicia of the plurality of visual indicia of the garment that is worn by the first person.

14. The method of claim 7, wherein the at least one unique visual characteristic is one of color and shape.

15. The method of claim 7, wherein the secondary visual characteristic is the other one of color and shape that is not the at least one unique visual characteristic.

16. The method of claim 7, wherein the secondary visual characteristic of each of the indicia is consistent across multiple indicia of the plurality of visual indicia in a corresponding distinct region and the unique visual characteristic is distinct for each of the indicia.

17. The method of claim 7, further comprising preparing at least one instruction of using the plurality of visual indicia.

* * * * *